US008230868B2

(12) United States Patent
Choi

(10) Patent No.: US 8,230,868 B2
(45) Date of Patent: Jul. 31, 2012

(54) HAIR IRON HAVING BUFFER MEMBER

(76) Inventor: Young-bum Choi, Goyang-si (KR)

( * ) Notice: Subject to any disclaimer, the term of this patent is extended or adjusted under 35 U.S.C. 154(b) by 104 days.

(21) Appl. No.: 12/648,677

(22) Filed: Dec. 29, 2009

(65) Prior Publication Data

US 2010/0101599 A1 Apr. 29, 2010

Related U.S. Application Data

(63) Continuation-in-part of application No. 11/170,407, filed on Jun. 29, 2005, now abandoned.

(30) Foreign Application Priority Data

Mar. 2, 2005 (KR) ..... 10-2005-0017244

(51) Int. Cl.
*A45D 2/40* (2006.01)
*A45D 1/04* (2006.01)

(52) U.S. Cl. ..... 132/224; 132/225; 219/225

(58) Field of Classification Search ..... 132/224–229, 132/269; 219/225–229
See application file for complete search history.

(56) References Cited

U.S. PATENT DOCUMENTS

| | | | | |
|---|---|---|---|---|
| 4,819,674 | A | 4/1989 | Takimae | |
| 5,046,516 | A | 9/1991 | Barradas | |
| 5,799,671 | A | 9/1998 | Takimae | |
| 6,173,718 | B1 | 1/2001 | Okumoto et al. | |
| 6,386,206 | B2 * | 5/2002 | Lee | 132/225 |
| 2002/0290047 | | 12/2002 | Nam | |
| 2005/0016557 | A1 | 1/2005 | Fasan | |

FOREIGN PATENT DOCUMENTS

| | | | |
|---|---|---|---|
| EP | 0273538 | A2 | 3/1987 |
| GB | 2402876 | A | 12/2004 |
| JP | 54168983 | | 11/1970 |
| JP | 5424482 | | 2/1979 |
| JP | 56114702 | | 9/1981 |
| JP | 2001104036 | | 4/2001 |

* cited by examiner

*Primary Examiner* — Robyn Doan

(74) *Attorney, Agent, or Firm* — Lee, Hong, Degerman, Kang & Waimey

(57) ABSTRACT

The present invention relates to a hair iron having a buffer member, particularly to a hair iron having a buffer member, which is located in between two opposing heating plates to help hair passing through the heating plates to be straightened smoothly and prevent thermal deformation of hair. The invention is characterized by a hair iron comprising a first pressing member 10 and a second pressing member 20 to which heating plates 12 and 22 having built-in thermal wire heaters 13 and 23 are attached, respectively. A buffer member 40 is attached to the heating plate 22 which is attached to the second pressing member 20.

19 Claims, 5 Drawing Sheets

HAIR IRON HAVING BUFFER MEMBER

CROSS REFERENCE TO RELATED APPLICATIONS

This application is a continuation-in-part of U.S. patent application Ser. No. 11/170,407 filed on Jun. 29, 2005, which claims priority to and the benefit of Korean Patent Application No. 10-2005-0017244 filed on Mar. 2, 2005, all of which are herein incorporated by reference in their entirety.

BACKGROUND OF THE INVENTION

1. Field of the Invention

The present invention relates to a hair iron having buffer members, particularly to a hair iron having buffer members, which are located in between two opposing heating plates to help hair between the heating plates to be straightened smoothly and prevent thermal deformation of hair.

2. Description of the Related Art

A hair iron is an apparatus used to straighten or roll hair at home or beauty salons. FIG. 1 is a drawing showing the conventional hair iron. It is manufactured by inserting heating wires 13*b* into two opposing heating plates 12*b*. When the heating plates 12*b* are heated by the heating wires 13*b*, users can straighten or roll their hair by applying pressure from outside of the external case 11*a*. Such a conventional hair iron is driven by a power supply. Descriptions on the power supply, including electric wires and the temperature controller 70, will be omitted here.

A first pressing member 1 and a second pressing member 2 are joined by a hinge 5. To the first pressing member 1 is fixed a spacing stick 60. The spacing stick 60 has a horizontally expanded part 61 at the end. The second pressing member 2 has a spacing member 62, which allows the spacing stick 60 to move up and down. Thus, the spacing between the first pressing member 1 and the second pressing member 2 can be adjusted by pressing with fingers. At the bottom of the spacing member 62 is mounted a spring 63.

In the conventional hair iron, the heating plates 12*b* touch with each other, so that it does not fix hair smoothly. Also, hair may be damaged because of the heated heating plates. Therefore, buffer members are required to prevent hair from being damaged and deformed and to remove moisture from hair effectively.

Another conventional hair iron is illustrated in Japanese patent publication No. 2001-104036 and shown in FIGS. 2A and 2B. Referring to FIGS. 2A and 2B, the hair iron has two grip blocks 300 and 300' in similar to that shown in FIG. 1. Four rollers 400 to 403 and two heating plates 310 and 310' are included in the grip blocks 300 and 300'. Since the two grip blocks 300 and 300' is gripped by hand, they should be made of a heat-resistant material. Two pairs of the rollers 400 to 403 are rotated in grooves when hair is arranged or straighten. Further, the rollers 400 to 403 are not disposed on the heating plates 310 and 310' but deviated from the direct heating region of the heating plates 310 and 310'. The rollers 400 to 403 are made of a material with a high heat conduction coefficient in order to keep the effective heat treatment of the hair. In this case, the relatively high heating temperature of the heating plates 310 and 310' must be maintained to provide heat for the rollers 400 to 403 and the rolling operation must is guaranteed exactly when straightening hair.

However, it is very difficult to guarantee the exact rolling because the rollers 400 to 403 are just disposed in the grooves without any auxiliary supporting members. Furthermore, since the rolling condition in the pair of the rollers 400 and 401, which hair enters, is different from another rolling condition in the pair of the rollers 402 and 403, the hair treatment is not smooth during styling. Moreover, since the grip blocks 300 and 300' are made of a heat-resistant material, there are two temperature zones. The first temperature zone is positioned at a center zone between the rollers and the second temperature zone is positioned at the rollers 400 to 403 and the outside thereof. Since a part of hair is between the rollers 400 to 403 in a first temperature zone and another part of hair is between the heating plates 310 and 310' in a second temperature zone during styling, the straightening or arranging is not smooth to cause damage to hair.

SUMMARY OF THE INVENTION

It is an object of the present invention to provide a hair iron having buffer member which are located in between two opposing heating plates to help hair between the heating plates to be straightened smoothly and prevent thermal deformation of hair.

To attain the object, the present invention provides a hair iron comprising a first pressing member and a second pressing member having heating plates, in which thermal wire heaters are built in, respectively, wherein buffer members are attached to the heating plate attached to the second pressing member.

DETAILED DESCRIPTION OF THE INVENTION

Hereunder the invention is described in more detail, referring to the attached drawings.

Figure 1:
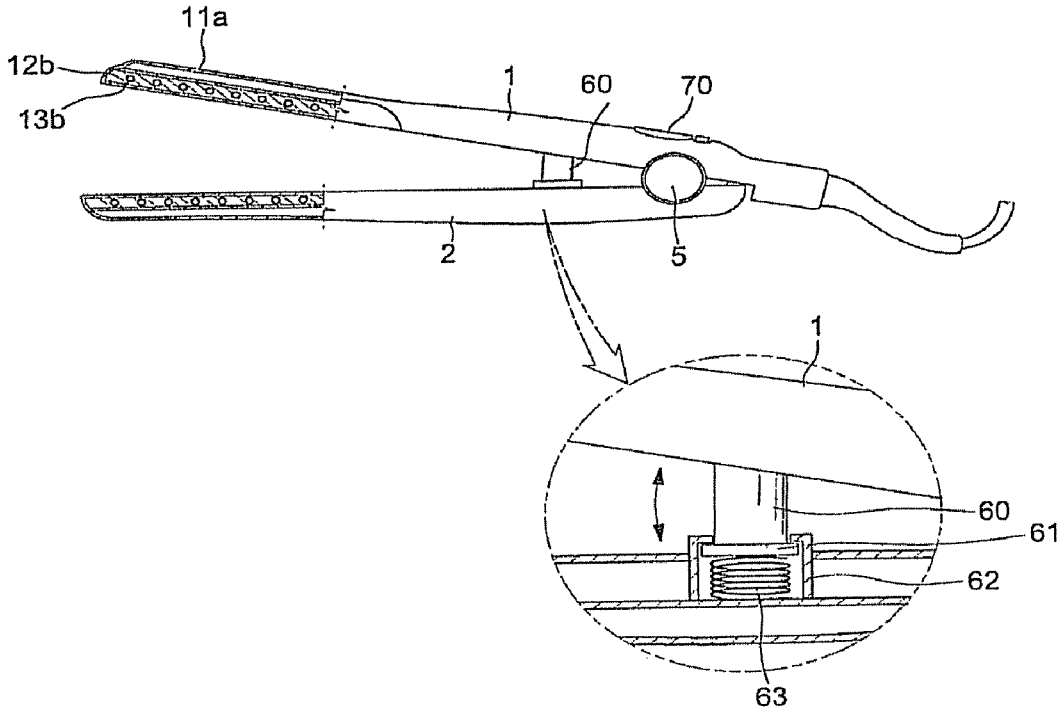
FIG. 1 shows a conventional hair iron.
Figure 2A:
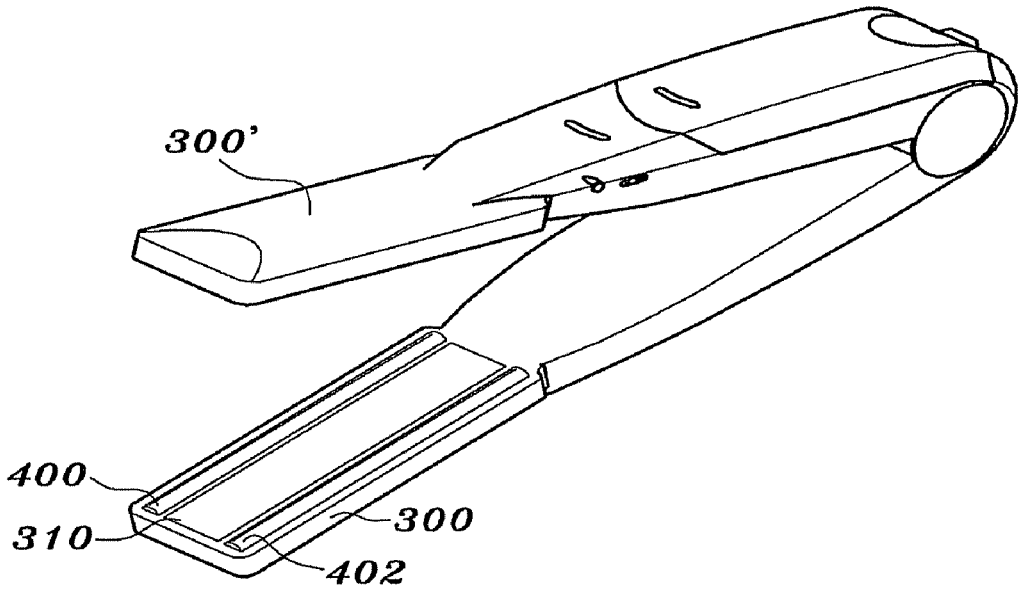
FIGS. 2A and 2B show another conventional hair iron with rollers.
Figure 2B:
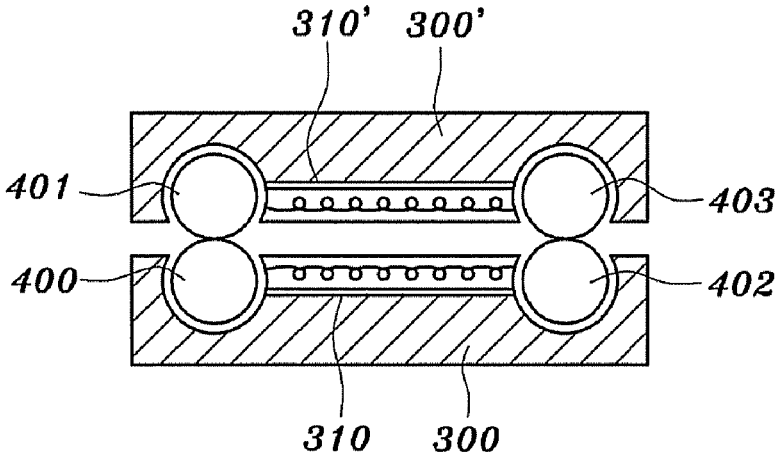
Figure 3A:
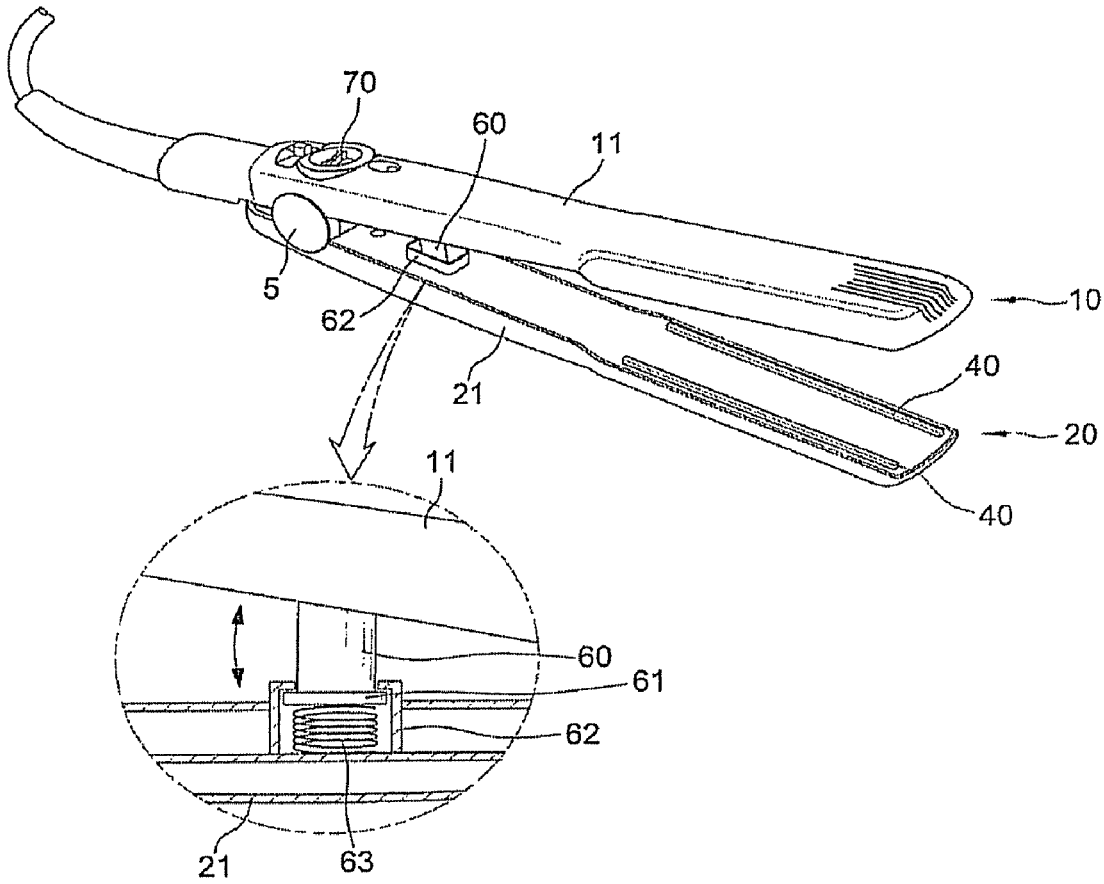
FIGS. 3A and 3B shows a hair iron having first and second pressing members according to one embodiment of the present invention.
Figure 3B:
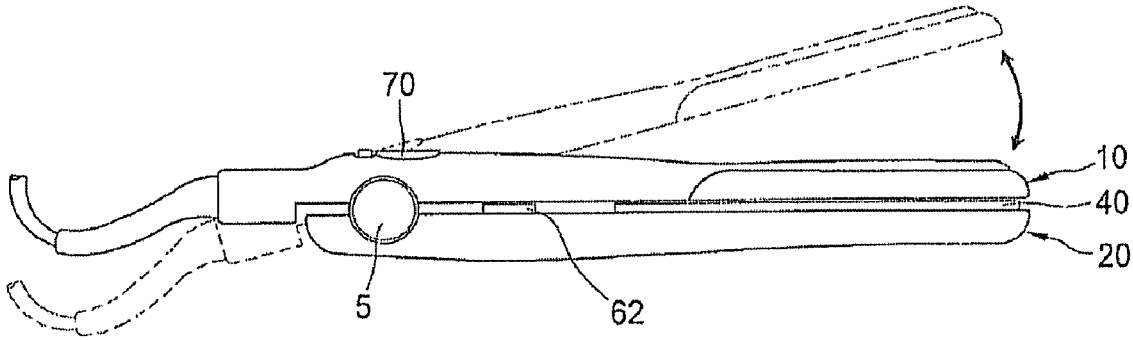
Figure 4:
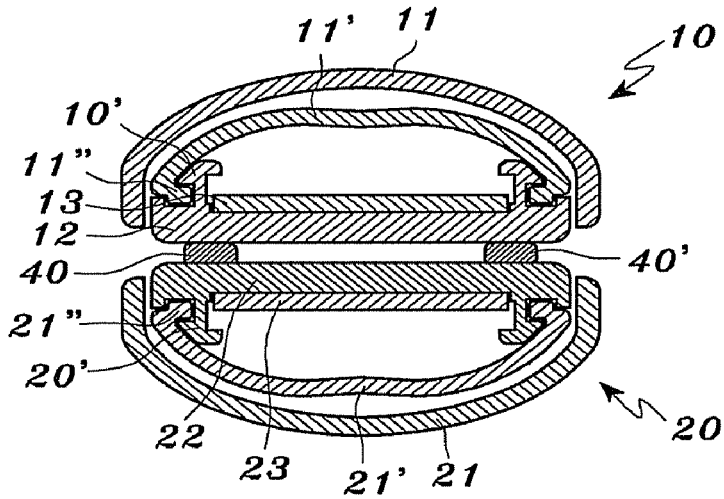
FIG. 4 shows a cross-section of the hair iron in which the second pressing member has a buffer member.
Figure 5:
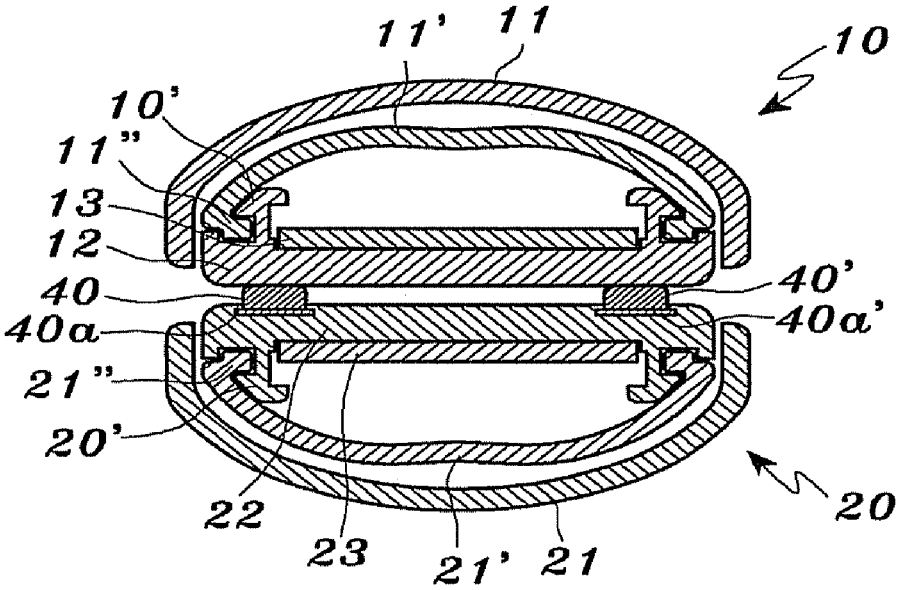
FIG. 5 shows a cross-section of the second pressing member having another buffer member.

Referring to FIGS. 3A and 3B, a hair iron according to the present invention includes a first pressing member 10 and a second pressing member 20. Referring to FIGS. 4 and 5, the first and second pressing members 10 and 20 have heating plates 12 and 22, to which heaters 13 and 23 are attached, respectively, and buffer members 40 and 40' are attached to both sides of the heating plate 22 which is attached to the second pressing member 20. In this invention, each of the heating plates 12 and 22 means a single member to transfer heating temperature from a heater to hair. The heater 23 and heating plate 22 can be assembled in a body or implemented by separate elements with a high heat conductance. Furthermore, since the buffer members 40 and 40' are disposed on the heating plate 22, the only one temperature zone is created in between the first and second pressing members 10 and 20.

It should be noted that the buffer members 40 and 40' are formed on the heating plate 22 so that they and hair to be thermal-treated are positioned at the same temperature zone.

The buffer members 40 and 40' are made of heat-resistant silicone. Once the buffer members 40 and 40' and the heating plates 12 and 22 are heated at the same temperature zone, hair is straightened by the hair iron at the same condition so that the hair straightening is smoother. The buffer members 40 and 40' may be either attached on the surface of the heating plate 22 or inserted in a groove 22*a* formed on the surface of the heating plate 22. Referring to FIG. 4, the buffer members 40 and 40' may be attached on the surface of the heating plate 22 of the second pressing member 20. In addition to heat-resistant silicone, the buffer members 40 and 40' may be made of any other materials that are elastic and heat resistant. In case that the buffer members 40 and 40' are the above-mentioned thermal expansion substance, the structure of them may be different from those of the heat resistance, which will be described below in detail.

External cases 11 and 21 of semicircle housings cover the whole structure of the heating plates 12 and 22, the heaters 13 and 23, and supporting housings 11' and 21', respectively. Since the first and second pressing members 10 and 20 are symmetrical in shape, the second pressing member 20 having the buffer members 40 and 40' will be described in detail.

In the case of the second pressing member 20, the external case 21 is mechanically joined to the outside of the heating plate 22. The supporting housing 21' of a semicircle housing has protrusion parts 21" at both ends thereof, grooves are formed at both ends of the second heating plate 22. In more detail, expended parts 20', which are vertically and downwardly expended from outside of the second heating plate 22, are formed and the grooves are formed in parallel between the both ends of the heating plate 22 and the expended parts 20'. The protrusion parts 21", which are expended from both ends of the supporting housing 21', are then inserted into the grooves, being engaged with the expended parts 20'. In the present invention, it should be noted that there is a space between the heating plate 22 and the supporting housing 21' to reduce the total weight of the hair iron. Preferably, the supporting housing 21' is mad of a heat-resistant material and a reflecting film can be coated on the supporting housing 21'.

Referring again to FIG. 3, the first and second pressing members 10 and 20 may open and shut by a hinge 5. A spacing stick 60 is fixed to the first or second pressing member 10 or 20. The spacing stick 60 has a horizontally expanded part 61 at the end to avoid breakaway from the second pressing member 20. The second pressing member 20 has a spacing member 62, which allows the spacing stick 60 to move up and down. The spacing between the first pressing member 10 and the second pressing member 20 can be adjusted by a pressure of the first and second pressing members 10 and 20 with fingers. At the bottom of the spacing member 62 is mounted a spring 63.

Although the buffer members 40 and 40' are attached on the heating plate 22 (FIG. 4), they are disposed in grooves (FIG. 5) of the heating plate 22. Heat-resistant silicone is inserted into the grooves as the buffer members 40 and 40'. Particularly, referring FIG. 5, the members 40 and 40' have horizontally expanded parts 40*a* and 40*a'* in order to prevent the members 40 and 40' from breakaway from the grooves of the heating plate 22. That is, the horizontally expanded parts 40*a* and 40*a'* are inserted into the grooves, and thus the buffer members 40 and 40' are not separated from the heating plate 22.

Like other conventional hair irons, the hair iron of the present invention has a temperature controller 70, power supply wires, etc. as a means of controlling temperature. Detailed description thereabout is omitted, because it is well known in the related art.

On the surface of the heating plates 12 and 22 is formed a ceramic coating, Teflon coating or anodizing coating. The heat-resistant silicone used in the invention can endure up to 100-230° C.

Hereunder is given a description of how to straighten or roll hair using the hair iron of the present invention.

First, plug in the power supply to heat the heating plates 12 and 22. While the heating plates 12 and 22 are heated, the temperature controller 70 maintains the temperature adequately.

Then, hair that is located in between the opposing first and second pressing members 10 and 20 is smoothly pulled by the hair iron while pressing the outside of the first and second pressing members with hand. At this point, hair is pressed in between the heating plate 12 and the buffer members 40 and 40' and heat is transferred to the hair. Because the buffer members 40 and 40' are made of heat-resistant silicone which is elastic, the hair can be effectively pressed. Consequently, hair can be straightened.

Hair located between the buffer members 40 and 40', which are attached on or inserted into the heating plate 22 of the second pressing member 20, and the heating plate 12 is pressed well and glides smoothly, because the heat-resistant silicone is soft and the whole hair within the hair iron is disposed at the same temperature. Also, because the heat-resistant silicone is located between the metallic heating plates 12 and 22, damage done to hair by heat can be reduced. The buffer member 40 may be replaced with a new one after prolonged use.

The hair iron of the present invention has the buffer members 40 and 40' which prevent hair from being directly pressed by the heating plates 12 and 22. The buffer members 40 and 40' also hold hair smoothly and hair damage can be prevented.

Figure 6:
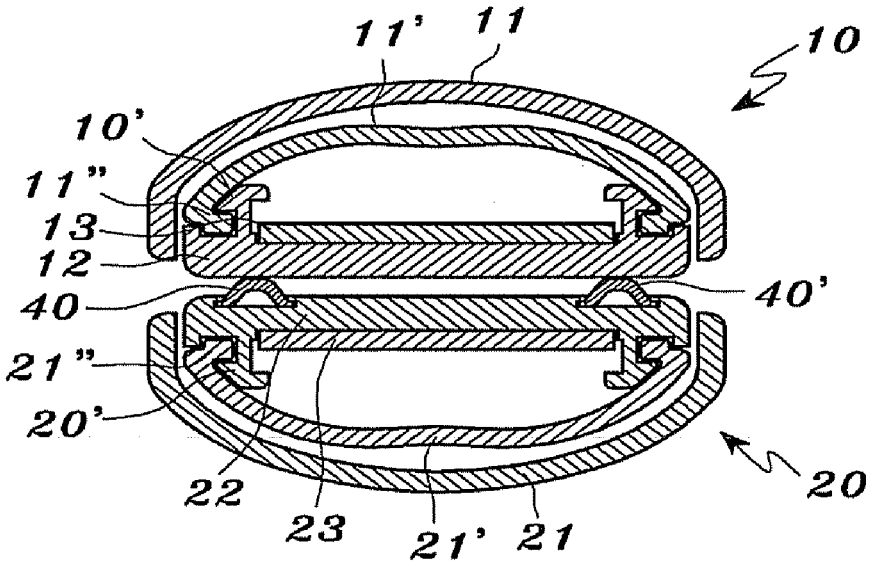
FIG. 6 shows a thermal expansion of the buffer members in the second pressing member according to another embodiment of the present invention.

Referring to FIG. 6, a substance having an expansion coefficient can be used for the buffer members 40 and 40'. In this embodiment, the buffer members 40 and 40' are also disposed within the grooves of the heating plate 22; however, it is not necessary to protrude prominently from the surface of the heating plate 22 at the normal state where electric power is not applied to the hair iron. Once power is applied to the hair iron and the heating plates 12 and 22 are increased up to a predetermined temperature, the buffer members 40 and 40' are expanded and then the top portions of the expanded buffer members 40 and 40' are thermally protruded from the surface of the heating plate 22.

Figure 7:
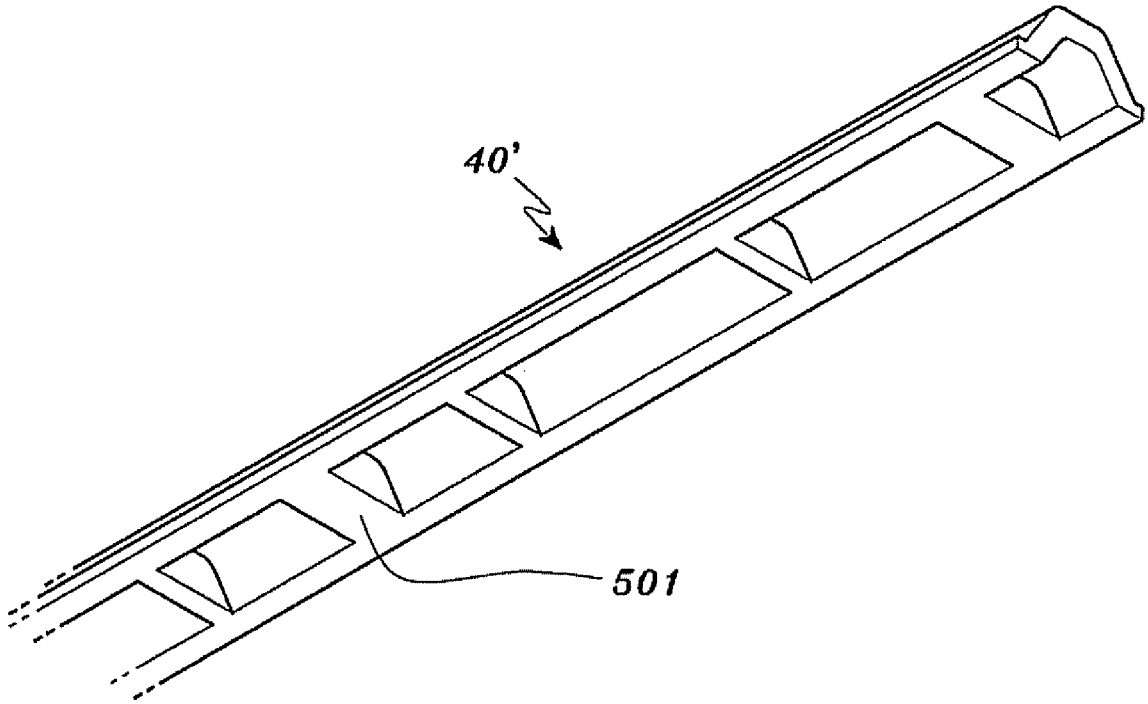
FIG. 7 is an enlarged perspective view of the buffer members in FIG. 5.

Referring to FIG. 7, the buffer members 40 and 40' in the heating plate 22 of FIG. 6 have a reversed V- or U-shape approximately and a plurality of supporting bars 501 which are provided to maintain the reversed V- or U-shape. The members 40 and 40' may be thermally protruded upward in a range of 0.1 to 1.5 mm. Typically, the members 40 and 40' may be protruded at a temperature of 180 to 230° C.

The buffer members of the present invention prevent hair from being pulled off and makes hair straightening or rolling more pleasant when using a hair iron. While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A hair iron comprising:

a first pressing member having a first heating plate, wherein the first heating plate is directly heated by a first heater;

a second pressing member having a second heating plate, wherein the second heating plate is directly heated by a second heater and wherein the first and second heating plates form a heating zone for hair to be straightened or arranged;

buffer members formed on the second heating plate and in the heating zone, wherein the buffer members have a reversed V- or U-shape and include supporting bar members to maintain the reversed V- or U-shape of the buffer members;

whereby the buffer members prevent damage to hair by preventing hair from being pressed directly by the first and second heating plates.

2. The hair iron of claim 1, further comprising two grooves formed on a surface of the second heating plate and positioned in the heating zone, wherein the two grooves are parallel to each other, and wherein the buffer members are inserted into the two grooves.

3. The hair iron of claim 2, wherein the first pressing member includes:

a first semicircle housing containing the first heating plate; and a first semicircle supporting member to fix the first heating plate to the first semicircle housing, providing a space between the first semicircle supporting member and the first heating plate.

4. The hair iron of claim 3, wherein the second pressing member includes:

a second semicircle housing containing the second heating plate; and a second semicircle supporting member to fix the second heating plate to the second semicircle housing, providing a space between the second semicircle supporting member and the second heating plate.

5. The hair iron of claim 4, wherein the second semicircle supporting member includes protrusion parts at both ends thereof, wherein the second heating plate includes expended parts that are downwardly expended from both ends thereof, and wherein the protrusion parts are engaged with the expended parts.

6. The hair iron of claim 5, wherein each of the first and second semicircle supporting members has protrusion parts at ends hereof, wherein grooves are formed between end parts of the second heating plate and expended parts which are downwardly or upwardly expended from outside of the second heating plate, and wherein the protrusion parts are inserted into the grooves.

7. The hair iron of claim 1, wherein the buffer members are made of a heat-resistant material.

8. The hair iron of claim 7, wherein the heat-resistant material is silicone.

9. The hair iron of claim 1, wherein the buffer members are made of a substance having an expansion coefficient, whereby the buffer members are upwardly expanded by a heating temperature in the heating zone.

10. The hair iron of claim 9, wherein a height of protrusion of the buffer members is in a range of 0.1 to 1.5 mm.

11. The hair iron of claim 9, wherein top portions of the buffer members are protruded from a surface of the second heating plate when power is applied to the hair iron and the heating plates are then increased up to a predetermined temperature.

12. A hair iron comprising:

a first pressing member;

a second pressing member disposed substantially opposite the first pressing member;

a first heating plate formed in the first pressing member, wherein the first heating plate is directly heated by a first heater;

a second heating plate formed on the second pressing member, wherein the second heating plate is directly heated by a second heater, and wherein the first and second heating plates form one heating zone over a whole area of the first and second heating plates;

grooves formed only on one of the first and second heating plates and in the same heating zone, the grooves including lower portions having a first width and an upper portion having a second narrow width;

buffer members inserted in the grooves, wherein the buffer members have a reversed V- or U-shape and include supporting bar members to maintain the reversed V- or U-shape of the buffer members, whereby the buffer members prevent damage to hair by preventing hair from being pressed directly by the first and second heating plates.

13. The hair iron of claim 12, wherein the buffer member is made of a substance having an expansion coefficient.

14. The hair iron of claim 12, wherein a top portion of each of the buffer members is protruded from a surface of the second heating plate when the heating plates are increased up to a predetermined temperature.

15. The hair iron of claim 12, wherein the first pressing member includes:

a first semicircle housing containing the first heating plate; and a first semicircle supporting member to fix the first heating plate to the first semicircle housing, providing a space between the first semicircle supporting member and the first heating plate.

16. The hair iron of claim 15, wherein the second pressing member includes:

a second semicircle housing containing the second heating plate; and a second semicircle supporting member to fix the second heating plate to the second semicircle housing, providing a space between the second semicircle supporting member and the second heating plate.

17. The hair iron of claim 16, wherein top portions of the buffer members are protruded from a surface of the second heating plate when power is applied to the hair iron and the heating plates are then increased up to a predetermined temperature.

18. A hair iron comprising:

a first pressing member comprising a first heating plate;

a second pressing member comprising a second heating plate, the first and second heating plates forming a heating zone therebetween for hair to be treated; and a buffer member extending from the second heating plate inside the heating zone, wherein the buffer member has a reversed V- or U-shape and comprises at least one supporting bar member to maintain the reversed V- or U-shape.

19. The hair iron of claim 18, further comprising a groove formed on a surface of the second heating plate, wherein the buffer member is inserted into the groove.

* * * * *